United States Patent [19]

Krippendorf et al.

[11] Patent Number: 4,979,538

[45] Date of Patent: Dec. 25, 1990

[54] WALL-MOUNT MIXING FAUCET

[75] Inventors: Manfred Krippendorf, Hemer; Peter Eisbach, Menden, both of Fed. Rep. of Germany

[73] Assignee: Friedrich Grohe Armaturen-Fabrik GmbH & Co., Hemer, Fed. Rep. of Germany

[21] Appl. No.: 485,225

[22] Filed: Feb. 26, 1990

[30] Foreign Application Priority Data

Mar. 9, 1989 [DE] Fed. Rep. of Germany ..... 3907585

[51] Int. Cl.[5] ..... F16L 5/00

[52] U.S. Cl. ..... 137/359; 137/360; 4/192

[58] Field of Search ..... 137/359, 360; 4/192

[56] References Cited

U.S. PATENT DOCUMENTS

| | | | |
|---|---|---|---|
| 1,693,778 | 12/1928 | Hennessey | 137/360 |
| 2,747,604 | 5/1956 | Fraser | 137/360 |
| 3,067,436 | 12/1962 | Freibott | 137/359 |
| 3,971,401 | 7/1976 | Persson | 137/360 |
| 4,662,389 | 5/1987 | Igbal | 137/359 |
| 4,848,395 | 7/1989 | Krippendorf | 137/359 |

FOREIGN PATENT DOCUMENTS

| | | |
|---|---|---|
| 2324023 | 11/1974 | Fed. Rep. of Germany . |
| 3723828 | 1/1989 | Fed. Rep. of Germany . |

*Primary Examiner*—A. Michael Chambers
*Attorney, Agent, or Firm*—Herbert Dubno; Andrew Wilford

[57] ABSTRACT

A faucet assembly has a wall plate having a pair of outlet ports adapted to be connected to hot- and cold-water supplies, a faucet having an end formed with inlet ports, and an adapter. The adapter has a pair of relatively telescoping parts formed with a pair of through-going passages extending between the parts. One of the parts is adapted to fit with the plate over the outlet ports thereof and the other part is adapted to fit with the faucet over the inlet ports thereof. Screws braced between the parts can relatively axially telescope same steplessly.

7 Claims, 2 Drawing Sheets

FIG.3
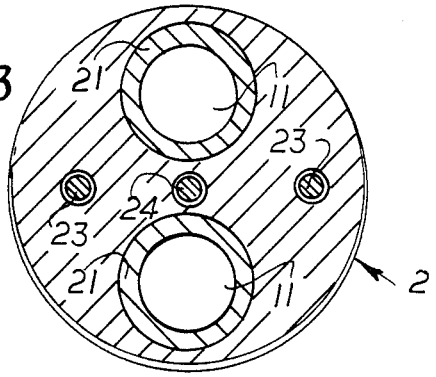
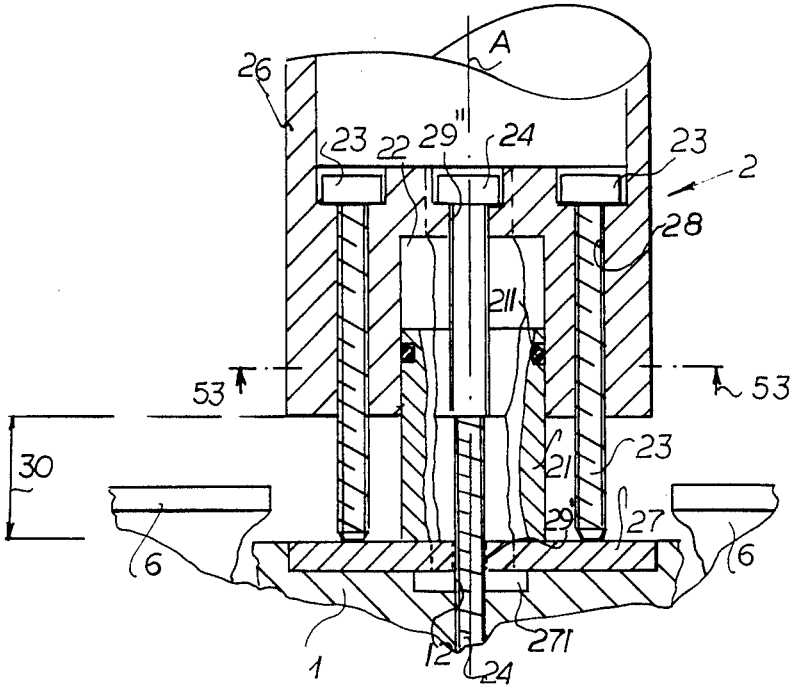
FIG.2

WALL-MOUNT MIXING FAUCET

FIELD OF THE INVENTION

The present invention relates to a faucet assembly. More particularly this invention concerns a wall-mount mixing faucet.

BACKGROUND OF THE INVENTION

A standard wall-mounted mixing faucet assembly is provided with a faucet formed with hot- and cold-water inlets and a mixed-water outlet, a valve for connecting the inlets to the outlet, and an actuating member for the valve. This faucet is carried on a wall-mounted fitting that is secured in the wall and that is formed with hot- and cold-water couplings as well as hot- and cold-water outlet ports. The couplings are behind the wall surface to which the fitting is secured and are connected to the incoming water lines. The ports are exposed at the wall and mate with the inlets of the faucet, and means is provided for securing the faucet on the fitting with the inlets over the ports.

Normally the wall-mounted fitting is mounted in place for when the pluming hookup is roughed in. Then the wall panel, typically moisture-resistant gypsum board, is fitted around the adapter fitting and the wall covering, for instance tile, is applied to the wall panel. Only then is the faucet secured to this fitting.

Provision must be made to accommodate different wall thicknesses between the wall-mounted fitting and the faucet. For instance a common wall in a multiple dwelling may have two layers of $\frac{5}{8}''$ gypsum board plus $\frac{1}{2}''$ of ceramic tile for a total thickness of $1\frac{3}{4}''$ while cheaper construction could have a single layer of $\frac{3}{8}''$ gypsum board covered with a membrane wall covering of insignificant thickness for a total thickness of about $\frac{3}{8}''$. Since the plumber doing the rough-in often has no clue about the final wall treatment, the adapter fitting must be able to accommodate a relatively wide range of wall thicknesses while still ensuring that the faucet will sit snugly on the wall and the connections to the faucet will not leak.

Thus as described in U.S. Pat. Nos. 3,880,183 and 4,846,207 various spacers are used as part of the adapter fitting. All of the spacers are employed for the thickest possible wall and none for the thinnest. Such an arrangement requires that the installer keep track of these various parts prior to installation and, unless they are saved, any subsequent change in wall covering will normally require a new kit to be obtained. Furthermore the adapter length is set in steps so that obtaining a snug fit of the faucet to the wall is unlikely unless by chance the wall thickness corresponds exactly to one of the settings for the adapter.

OBJECTS OF THE INVENTION

It is therefore an object of the present invention to provide an improved wall-mount faucet assembly.

Another object is the provision of such an improved wall-mount faucet assembly which overcomes the above-given disadvantages, that is which can readily and easily be adapted to fit to a wide range of wall thicknesses, which requires no extra parts, which can be adjusted steplessly, and which can be subsequently readjusted if the wall thickness changes.

SUMMARY OF THE INVENTION

A faucet assembly according to the invention has a wall plate having a pair of outlet ports adapted to be connected to hot- and cold-water supplies, a faucet having an end formed with inlet ports, and an adapter. The adapter has a pair of relatively telescoping parts formed with a pair of throughgoing passages extending between the parts. One of the parts is adapted to fit with the plate over the outlet ports thereof and the other part is adapted to fit with the faucet over the inlet ports thereof. Screws braced between the parts can relatively axially telescope same steplessly.

Thus with the system of this invention the length of the adapter is adjusted steplessly by means of the screws to compensate for walls of different thicknesses. The telescoping passages transmit the water from the wall plate to the faucet without leakage and, once the proper length is set, the system is stably supported on the wall plate, not braced against the wall where it could, for instance, crack the tile.

According to another feature of this invention the other part is formed with a pair of parallel bores forming front portions of the passages and matable with the inlet ports of the faucet and the one part is formed with a pair of parallel tubes forming rear portions of the passages, slidable in the respective bores, and matable with the outlet ports of the wall plate. Furthermore the screws include a mounting screw engaged through both of the parts and threaded in the other part and at least one spacing screw threaded through and projecting axially from one of the parts and bearing axially on the other part.

In accordance with further features of this invention a mounting sleeve axially coupled to the adapter is provided with coupling formations that mate with complementary such formations formed on the faucet to secure the sleeve and faucet together and thereby secure the faucet on the adapter. These formations can include short radially projecting studs on the sleeve and spiral or helical grooves formed on the faucet, or vice versa.

Furthermore a cover plate engaged around the adapter with the wall can be held in place by this sleeve or the faucet to form a neatly trimmed finish for the assembly. Finally the other part is formed with centering extensions engageable in the outlet ports of the wall plate.

DESCRIPTION OF THE DRAWING

The above and other objects, features, and advantages will become more readily apparent from the following, reference being made to the accompanying drawing in which:

FIG. 2 is an axial section through a portion of the assembly; and

FIG. 3 is a cross section taken along line S3—S3 of FIG. 2.

SPECIFIC DESCRIPTION

Figure 1:
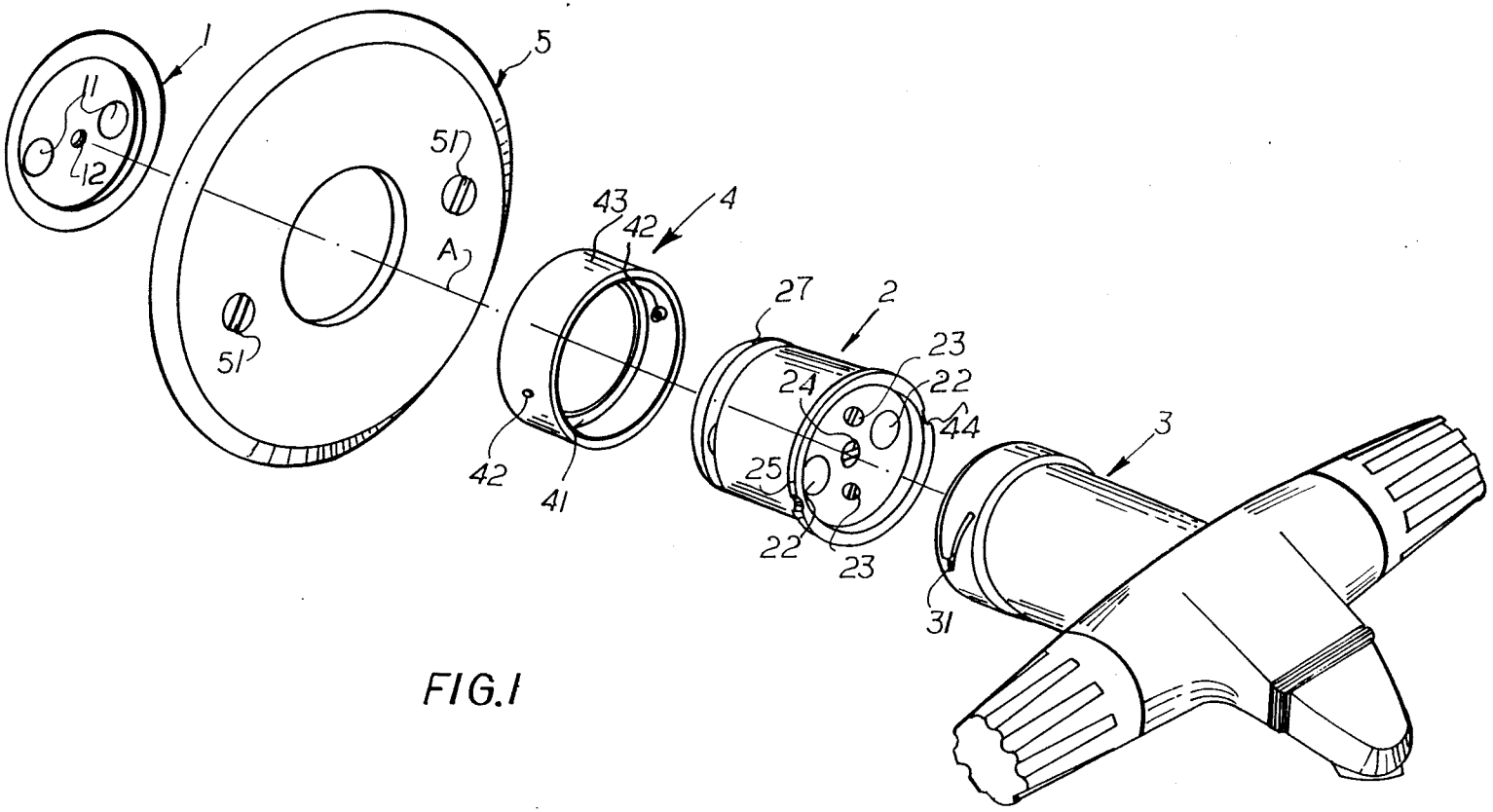
FIG. 1 is an exploded view of the faucet assembly according to this invention.

As seen in FIG. 1 a valve assembly basically comprises a wall-mounted plate 1, a wall-depth adapter fitting 2, a mixing faucet 3, a cover sleeve 4, and a cover plate or rosette 5.

The plate 1 as also shown in FIG. 2 is formed centered on a faucet axis A with a threaded bore 12 and is formed to each side of this bore with a port 11. The plate 1 is fixed by not illustrated lugs in a wall 6 so that its front face lies somewhat behind what will be the finished wall surface. One of the ports 11 is connected in the wall 6 to an incoming pressurized hot-water line and the other to a cold-water line. This plate 1 and its connections are mounted to the studs before the wall panel is installed.

The adapter fitting 2 is basically formed as two pieces, a plate 27 and a sleeve 26. The plate 27 is a flat circular disk formed on the axis A with a central unthreaded hole 29' alignable with the hole 12 On its back face the plate 27 is provided with two short centering collars 271 that can fit tightly in the ports 11 and aligned with these collars 27 the plate 27 carries on its front face two tubular nipples 21 that extend parallel to the axis A and diametrically flank it. The sleeve 26 is formed with a central unthreaded bore 29'' like the bore 29' and with two threaded bores 28 diametrically flanking this bore 29''. In addition this sleeve 26 is formed with stepped bores 22 that diametrally flank the axis A and that are complementary to the tubular nipples 21. These nipples 21 normally fit snugly within the bores 22, open at the front of the sleeve 26, and are provided with O-ring seals 211 that ensure a leak-tight fit.

According to this invention a main screw 24 normally extends through the bores 29' and 29'' and is threaded into the bore 12 of the plate 1, with the head of the screw 24 bearing axially backward on a counterbore in the front face of the sleeve 26. Spacer screws 23 are also threaded into the bores 28 and bear axially backward on the front face of the plate 27.

The sleeve 26 is also formed with a radially outwardly projecting ridge 25 at its front edge. This ridge 25 is formed with a pair of diametrally opposite and outwardly open notches 44. The sleeve 4 is cylindrically tubular and has at its rear edge an inwardly turned rim 41 and a cylindrical body 43 from which two short studs 42 project radially inward. These studs 43 can pass through the notches 44 in the ridge 25 and engage in respective spiral grooves 31 formed at the rear end of the faucet 3. The front end of the sleeve 26 is formed with a recess 32 complementary to the rear end of the faucet 3, which includes a mixing valve and spout as is well known in the art.

According to this invention once the wall 6 is completed, for instance with a layer of tile cut to fit around the plate 1 with a modest spacing, the sleeve 4 is fitted over the back of the adapter fitting 2 and the adapter fitting 2 with the sleeve 4 is fitted to the plate 1. To start with the screws 23 are screwed all the way in so that the back face of the sleeve 26 is at a maximum spacing 30 from the front face of the plate 27. Then the adapter 2 is fitted to the plate 1 with the collars engaging in the ports 11.

The screw 24 is then fitted through the holes 29' and 29'' to the hole 12 and the installer backs the screws 23 out of the holes 28 and screws the screw 24 in to telescope the sleeve 26 back on the nipples 21 while maintaining the plate 27 tight against the plate 1, until the back face of the sleeve 26 bears snugly against the wall 6. Such adjustment may leave the heads of the screws 23 standing somewhat proud of the counterbored bores 28 but the back of the faucet 3 is formed with complementary recesses so that such projecting screws 23 do not interfere with mounting the faucet 3.

Thus the two parts 26 and 27 of the adapter 2 are held apart by the screws 23 while the entire adapter 2 is solidly secured to the plate 1 by the screw 24. The height of the adapter 2 above the outer wall surface will therefore be exactly equal to the axial length of the sleeve 26, and the range of adjustment is equal to the maximum spacing 30, which can be fairly large.

Subsequently the rosette 5 is slipped over the adapter 2 and sleeve 4 and is caulked and secured by screws 51. Then the faucet 3 is mounted on the front end of the sleeve 26 by fitting its rear end into the front end of the sleeve 26 and then engaging the studs 43 to the grooves 31 and turning the sleeve 4. The sleeve 4 therefore serves to lock the faucet 3 on the adapter 2 while covering the joint. The resultant assembly is extremely neat and yet does not bear directly on the wall 6; instead it is wholly carried by the plate 1 which itself is fixed to the structure within the wall, normally bolted to a stud or to a nailer itself fixed to the studs.

We claim:

1. A faucet assembly comprising:

a wall plate having a pair of outlet ports adapted to be connected to hot- and cold-water supplies;

a faucet having an end formed with inlet ports; and an adapter including a pair of relatively telescoping parts formed with a pair of throughgoing passages extending between the parts, one of the parts being adapted to fit with the plate over the outlet ports thereof and the other part being adapted to fit with the faucet over the inlet ports thereof, and screws braced between the parts for relatively axially telescoping same steplessly.

2. The faucet assembly defined in claim 1 wherein one the other part is formed with a pair of parallel bores forming front portions of the passages and matable with the inlet ports of the faucet and the one part is formed with a pair of parallel tubes forming rear portions of the passages, slidable in the respective bores, and matable with the outlet ports of the wall plate.

3. The faucet assembly defined in claim 2 wherein the screws include a mounting screw engaged through both of the parts and threaded in the other part; and at least one spacing screw threaded through and projecting axially from one of the parts and bearing axially on the other part.

4. The faucet assembly defined in claim 1, further comprising a mounting sleeve axially coupled to the adapter and provided with coupling formations, the faucet provided further coupling formations matable with those of the mounting sleeve to secure the sleeve and faucet together and thereby secure the faucet on the adapter.

5. The faucet assembly defined in claim 1, further comprising a cover plate engaged around the adapter with the wall.

6. The faucet assembly defined in claim 1 wherein the other part is formed with centering extensions engageable in the outlet ports of the wall plate.

7. A faucet assembly comprising:

a wall plate having a pair of outlet ports adapted to be connected to hot- and cold-water supplies;

a faucet having an end formed with inlet ports; and an adapter including a wall part adapted to fit with the plate over the outlet ports thereof, a faucet part adapted to fit with the faucet over the inlet ports thereof, one of the parts being formed with a pair of axially extending parallel bores open axially toward the other part and the other part being formed with a pair of parallel tubular nipples engaged and slidable in the bores, the nipples and bores together forming passages extending through the adapter, and at least one spacing screws threaded into the faucet part and projecting therefrom axially in one direction toward the other part and engaging the other part axially in the one direction, and a mounting screw engaged through both of the parts, threaded in the wall plate, and bearing axially in the one direction on the faucet part.

* * * * *